US006422553B1

(12) United States Patent
Asao

(10) Patent No.: US 6,422,553 B1
(45) **Date of Patent: *Jul. 23, 2002**

(54) SHEET POST-PROCESSING APPARATUS

(75) Inventor: Yusuke Asao, Yamanashi-ken (JP)

(73) Assignee: Nisca Corporation, Yamanashi-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/989,975

(22) Filed: Dec. 12, 1997

(30) Foreign Application Priority Data

Dec. 18, 1996 (JP) ..... 8-354370
Dec. 18, 1996 (JP) ..... 8-354371
Dec. 18, 1996 (JP) ..... 8-354372

(51) Int. Cl.[7] ..... B65H 39/02

(52) U.S. Cl. ..... 270/58.11; 270/58.16; 270/58.18

(58) Field of Search ..... 270/58.11, 58.12, 270/58.13, 58.14, 58.08, 58.07, 58.19, 58.15, 58.16, 58.18; 414/790.3

(56) References Cited

U.S. PATENT DOCUMENTS 4,540,458 A * 9/1985 Baughman et al. .. 270/58.08 X
4,611,741 A * 9/1986 Wilson ..... 270/58.12 X
5,106,067 A * 4/1992 Higaki ..... 270/58.08
5,508,799 A * 4/1996 Irie ..... 270/58.07 X
5,580,039 A * 12/1996 Takehara et al. ..... 270/58.11

FOREIGN PATENT DOCUMENTS

| | | |
|---|---|---|
| JP | 62288090 | 12/1987 |
| JP | 2276691 | 11/1990 |
| JP | 4290800 | 10/1992 |
| JP | 6-56324 | 3/1994 |
| JP | 7-76190 | 3/1995 |

* cited by examiner

*Primary Examiner*—Christopher P. Ellis
*Assistant Examiner*—Patrick Mackey
(74) *Attorney, Agent, or Firm*—Pitney, Hardin, Kipp & Szuch LLP

(57) ABSTRACT

A sheet post-processing apparatus is connected to or assembled in an image forming device such as a copying machine to automatically bind recorded or copied sheets successively given from the image forming device with one or more staples upon collating, aligning and binding or punching the given sheets in the proper order of page. The finished sheets bound are finally discharged perpendicularly to a reference transferring direction in which the recorded sheet is first sent out from the image forming device so as to be discharged to a discharge unit near an operation place defined in front of the image forming device, thus to allow an operator to easily take out the bound sheets from the sheet discharge unit without moving too much.

12 Claims, 10 Drawing Sheets

SHEET POST-PROCESSING APPARATUS

BACKGROUND OF THE INVENTION

1. Field of the Invention

This invention relates to a sheet post-processing apparatus for automatically collating, aligning and binding recorded sheets, which are successively sent out one by one from a copying machine, printer or the like in the order of page, by using a built-in stapler or puncher.

2. Description of the Prior Art

There has been a bookbinding or post-processing system installed in or attached to an image forming device such as a copying machine and printer so as to automatically align and bind recorded or printed sheets arriving from the image forming device with one or more staples. In general, the copying machine of large size is provided on its front side portion with an operating is console panel and on one lateral side portion with a sheet discharging unit to which the copied or recorded sheet is sent out.

In case where a sheet sorting unit for automatically sorting the recorded sheets successively delivered from the copying machine is attached to the lateral side portion of the copying machine, the work of extracting a sheaf of sorted sheets from the sorting unit is not so onerous because an operator can easily access the sorting unit to take out the finished sheaf of sheets bound without moving too much from the operation place in front of the copying machine.

However, when a sheet post-processing apparatus capable of automatically collating, aligning and binding sheets arriving from the copying machine is attached to the lateral side of the copying machine, the operator will be compelled to move from the operation place on the front side to the lateral side of the system in order to take out the finished sheets bound and discharged from the sheet post-processing apparatus which ordinarily has one or more discharge trays on the lateral side far from the operation place in front of the image forming device, because such a multi-function sheet post-processing apparatus is commonly large in size. The work of repeatedly operating the copying machine to copy and moving to take out the copied sheets turns out to be very troublesome chore.

Thus, the image forming system including the multi-function sheet post-processing apparatus is disadvantageous in that it calls for not merely the troublesome work of taking out the finished sheets bound in a sheaf discharged from the farthest side of the system, but also a sufficient space left for taking out the finished sheets on the lateral side.

In the copying machine which is typical of the image forming device, the finished or copied sheet is generally discharged with the image surface upward as a structural consequence of the copying machine. If the finished sheets successively sent out in the order of page from the copying machine are fed out with the image surfaces downward without being reversed and piled on top of the sheets which have already been discharged on a discharge tray, the sheets are inconveniently piled on one another in the reverse order of page on the discharge tray. Accordingly, the sheet post-processing apparatus to be applied to the copying machine of the type of discharging the finished sheet with the image surface upward necessitates a function of not only handling a single sheet which need not be turned upside down, but also causing the sheets delivered from the image forming device to be reversed.

OBJECT OF THE INVENTION

An object of the present invention is to provide a high-performance sheet post-processing apparatus to be attached or united to an image forming device such as a copying machine and a printer, which achieves a function of automatically collating, aligning and binding recorded or copied sheets successively sent out from the image forming device so as to effectively produce a finished sheets bound in a sheaf.

Another object of the present invention is to provide a convenient sheet post-processing apparatus capable of discharging the finished sheets, which are obtained by automatically collating, aligning and binding sheets successively delivered from the image forming device, to a position near an operator who is handling the image forming device.

Still another object of the present invention is to provide a sheet post-processing apparatus capable of permitting the recorded sheets successively sent out with the image surface upward from the image forming device in the specified order of page to be turned upside down for being stacked in the proper order of page on a sheet stacking platform so as to perform consecutive processes of automatically collating, aligning and binding or punching the sheets with high efficiency.

Yet another object of the present invention is to provide a sheet post-processing apparatus having ingenious passages for reliably transferring recorded or copied sheets arriving from the image forming device so as to make a system including the sheet post-processing apparatus compact.

A further object of the present invention is to provide a sheet post-processing apparatus for automatically binding recorded sheets, which can be readily applied to various image forming devices such as a copying machine.

SUMMARY OF THE INVENTION

To attain the objects described above according to the present invention, there is provided a sheet post-processing apparatus connected to or assembled in an image forming device to receive one or more sheets recorded in the image forming device and align and bind or punch the recorded sheets, comprising a processing portion having a sheet stacking platform for stacking the sheets fed from the image forming device and means for aligning the sheets stacked on the sheet stacking platform, and a sheet discharge unit situated perpendicularly to the direction in which the recorded sheet is sent out from the image forming device relative to the processing portion.

The image forming device to which the sheet post-processing apparatus is applied is provided in one lateral side with a sheet exit port through which the recorded sheet is discharged in a lateral direction defined as a reference transferring direction. The recorded sheet delivered from the image forming device in the reference transferring direction to the sheet post-processing apparatus changes its direction at right angles and discharged in the direction perpendicular to the prescribed reference transferring direction upon undergoing required processes of collating, aligning and binding. Thus, the sheets successively sent one by one to the processing portion are automatically stacked on the sheet stacking platform, aligned by the aligning means and bound in a sheaf with one or more staples by using a stapler.

The sheaf of sheets thus bound is discharged into one of discharge trays in the sheet discharge unit disposed on the side perpendicular to the reference transferring direction relative to the processing portion. Since the discharge trays are situated close to the operation place in front of the image forming device, the finished sheets can easily be taken out from the discharge trays.

The sheet sent out with the image surface upward from the image forming device into the sheet post-processing apparatus is forwarded to the processing portion through a sheet reversing path for turning the sheet upside down. In the same manner, the succeeding sheets successively given from the image forming device are turned upside down through the sheet reversing path and stacked on the sheets already placed on the sheet stacking platform in the same order of page as that of original documents given to the image forming device.

The sheets stacked in the specified order of page on the sheet stacking platform are automatically bound into a sheaf by the stapler, and then, discharged to the discharge unit situated near the operation place in front of the image forming device.

The sheet reversing path may be disposed on the perpendicular side, the downstream side or upstream side of the processing portion relative to the reference transferring direction. In the case of disposing the sheet reversing path on the perpendicular side, the direction in which the sheet arriving from the image forming device is forwarded may be changed at right angles on a sheet receiving stage before the sheet reversing path. In the case of arranging the sheet reversing path on the downstream or upstream side of the processing portion, the sheet fed from the image forming device may change its direction at right angles on the processing portion.

Instead of stapling the sheets stacked on the sheet stacking platform in the processing portion, the sheets may undergo a punching process to bore at least one hole to bind the sheets in a sheaf.

Since the sheaves of sheets thus bound are finally discharged to the discharge unit close to the operation place of the image forming device, an operator can easily take out the bound sheets from the sheet post-processing apparatus without moving too much from the operation place in front of the image forming device. Besides, since the sheet post-processing apparatus provided on its front side with the discharge unit need not secure a space on its lateral side, it is advantageous in being installed in a limited space.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
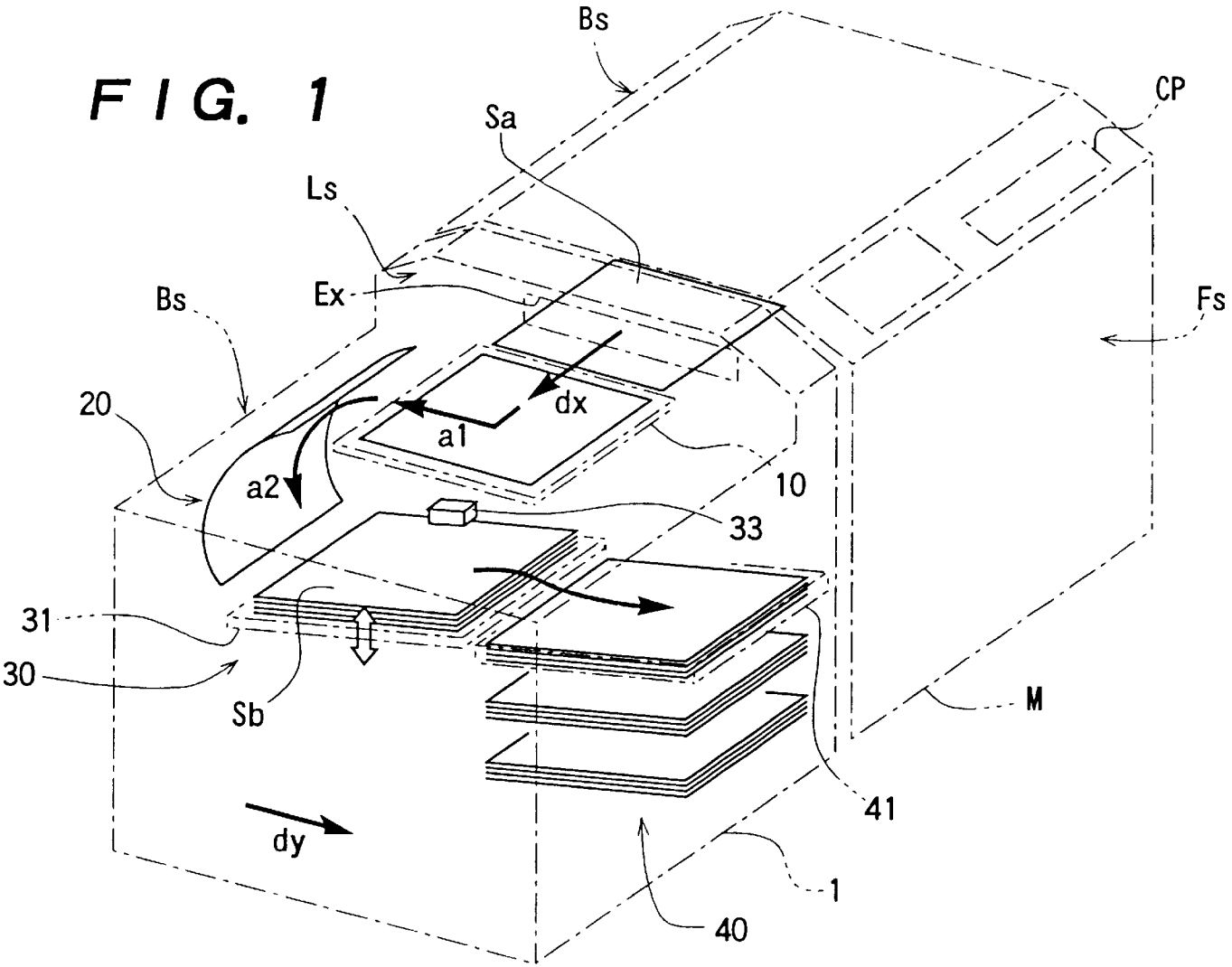
FIG. 1 is a conceptual diagram showing the manner of transferring a recorded sheet arriving from an image forming device in a first embodiment of a sheet post-processing apparatus according to this invention.

The present invention relates to a sheet post-processing apparatus to be attached to an image forming device such as a copying machine and printer, which serves to automatically collate, align and bind recorded, printed or copied sheets successively fed from the image forming device into a sheaf of sheets laid in the order of page, and finally, discharge the finished sheaf of sheets bound to a position close to an operation place in front of the image forming device so as to allow the finished sheaf of sheets bound to be taken out with ease. The sequence of transferring the sheet arriving from the image forming device in the first embodiment of the sheet post-processing apparatus of the invention is schematically shown in FIG. 1. The illustrated embodiment will be described on the premise that a copying machine is used as the image forming device M by way of example, and the recorded sheets Sa are successively sent out one by one with the image surface upward in the order of page from the image forming device.

The image forming device M is provided on its front side portion Fs with an operating console panel (operating portion) CP, and on its lateral side portion Ls with a sheet exit port Ex through which the recorded sheet Sa is discharged. That is, the recorded sheet Sa is sent out with the image surface upward from the image forming device M in the lateral direction (reference transferring direction dx).

The sheet post-processing apparatus 1 of the invention is connected to the image forming device M so as to receive the recorded sheet Sa delivered from the image forming device through the sheet exit port Ex.

The sheet post-processing apparatus 1 in this embodiment comprises a stage 10 for receiving the recorded sheets Sa one by one sent out from the image forming device M in the reference transferring direction dx, a sheet reversing path 20 having a sheet inlet 21 placed on the back side Bs of the sheet receiving stage 10, a processing portion 30 located under the sheet receiving stage 10 and including a sheet stacking platform 31 movable vertically, and a sheet discharge unit 40 having a plurality of discharge trays 41 arranged as separated vertically from one another.

The recorded sheets Sa successively delivered from the image forming device M are sent one by one onto the sheet stacking platform 31 through the sheet receiving stage 10 and the sheet reversing path 20, aligned by sheet aligning means 32, and bound by use of sheet binding means 33 such as a stapler into a sheaf of sheets.

In the sheet post-processing apparatus 1 of the illustrated embodiment, the direction of forwarding the recorded sheet Sa fed from the image forming device M to the sheet receiving stage 10 in the reference transferring direction dx is changed at right angles as indicated by the arrow a1 in FIG. 1, and then, the recorded sheet is forwarded along the sheet reversing path 20 in the backward direction perpendicular to the direction dx, consequently to be turned upside down as indicated by the arrow a2.

The sheet receiving stage 10 is provided with means 11 for changing the direction of the sheet Sa at right angles relative to the reference transferring direction dx.

Figure 2:
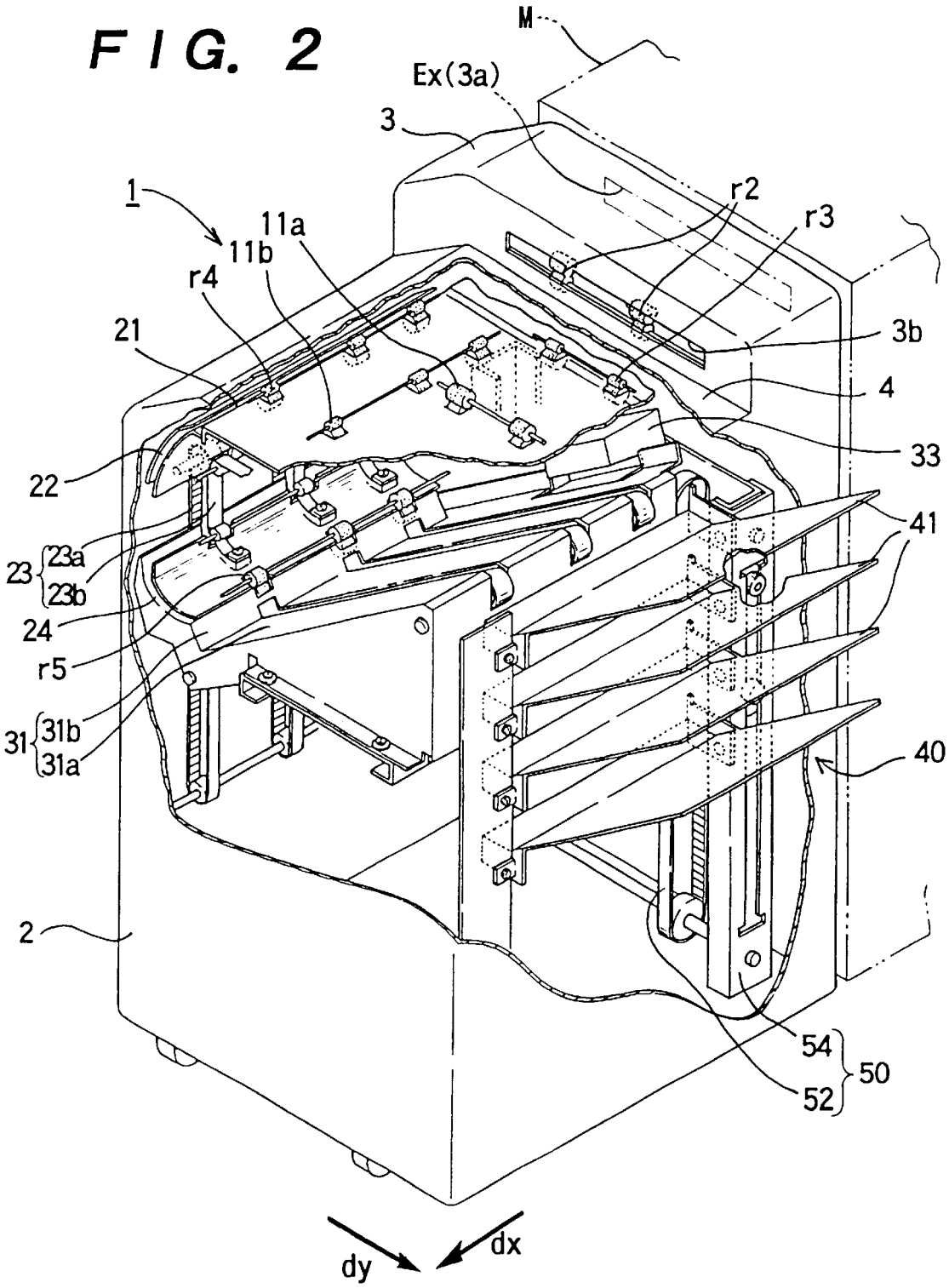
FIG. 2 is a partially cutaway perspective view showing the sheet post-processing apparatus of FIG. 1.

To be more specific, the sheet post-processing apparatus 1 of the invention has a housing 2 conformable in general configuration and size to the image forming device M, as shown in FIG. 2. The housing 2 has a sheet admission part 3 with a sheet entrance port 3*a* for admitting the recorded sheet Sa discharged from the image forming device M into the sheet post-processing apparatus 1.

The sheet admission part 3 further has an ejection port 3*b* from which a single recorded sheet having no need of being bound is sent out via a through path P1. Hence, the single recorded sheet given from the image forming device M is sent out to a discharge tray 4 as it is without undergoing any processing. In the drawings, reference symbols r1 and r2 denote feed rollers.

A path P2 to the sheet receiving stage 10 branches off from the through path P1. At a diverging point of the paths P1 and P2, a switching flap 5 is disposed for selectively forwarding the recorded sheet given from the image forming device M to either of the paths P1 and P2. When the recorded sheets given from the image forming device M are required to be bound, the switching flap 5 is operated to allow the sheet fed through the entrance port 3*a* to be forwarded toward the sheet receiving stage 10 through the path P2.

Thus, the recorded sheet Sa is sent into the sheet receiving stage 10 in the reference transferring direction dx. Then, the direction of forwarding the sheet Sa arriving in the sheet receiving stage 10 is changed to the direction perpendicular to the reference transferring direction dx by the direction changing means 11.

The direction changing means 11 incorporated in the sheet receiving stage 10 includes transversely feeding means 11*a* and breadthwise feeding means 11*b*. Both the transversely and breadthwise feeding means 11*a* and 11*b* each have movable driving rollers R1 and stationary driven rollers R2. The driving and driven rollers of the transversely feeding means 11*a* are held by rotary shafts extending perpendicularly to the reference transferring direction dx, and those of the breadthwise feeding means 11*b* are held by rotary shafts extending in the reference transferring direction dx.

The driving rollers R1 are movable to come into press contact with the stationary driven rollers R2, so that the driving and driven rollers in one of the feeding means 11*a* and 11*a* are in contact with each other when those in the other feeding means are separated from each other. That is, when the recorded sheet Sa enters into the sheet receiving stage 10, the driving rollers R1 of the transversely feeding means 11*a* come into contact with the counterpart driven rollers R2 while being driven to rotate, so that the sheet Sa is forwarded in the reference transferring direction dx until reaching the prescribed position on the sheet receiving stage 10. At this time, the driving rollers R1 and the driven rollers R2 of the breadthwise feeding means 11*b* are separate from each other. Thereafter, when the sheet Sa arrives at the prescribed position on the sheet receiving stage 10, the driving rollers R1 of the transversely feeding means 11 are separated from the counterpart driven rollers R2, and simultaneously, the driving and driven rollers R1 and R2 of the breadthwise feeding means 11*b* come into contact with each other, so that the sheet Sa is forwarded in the perpendicular direction to the reference transferring direction dx toward the sheet reversing path 20 placed on the back side Bs.

Figure 5:
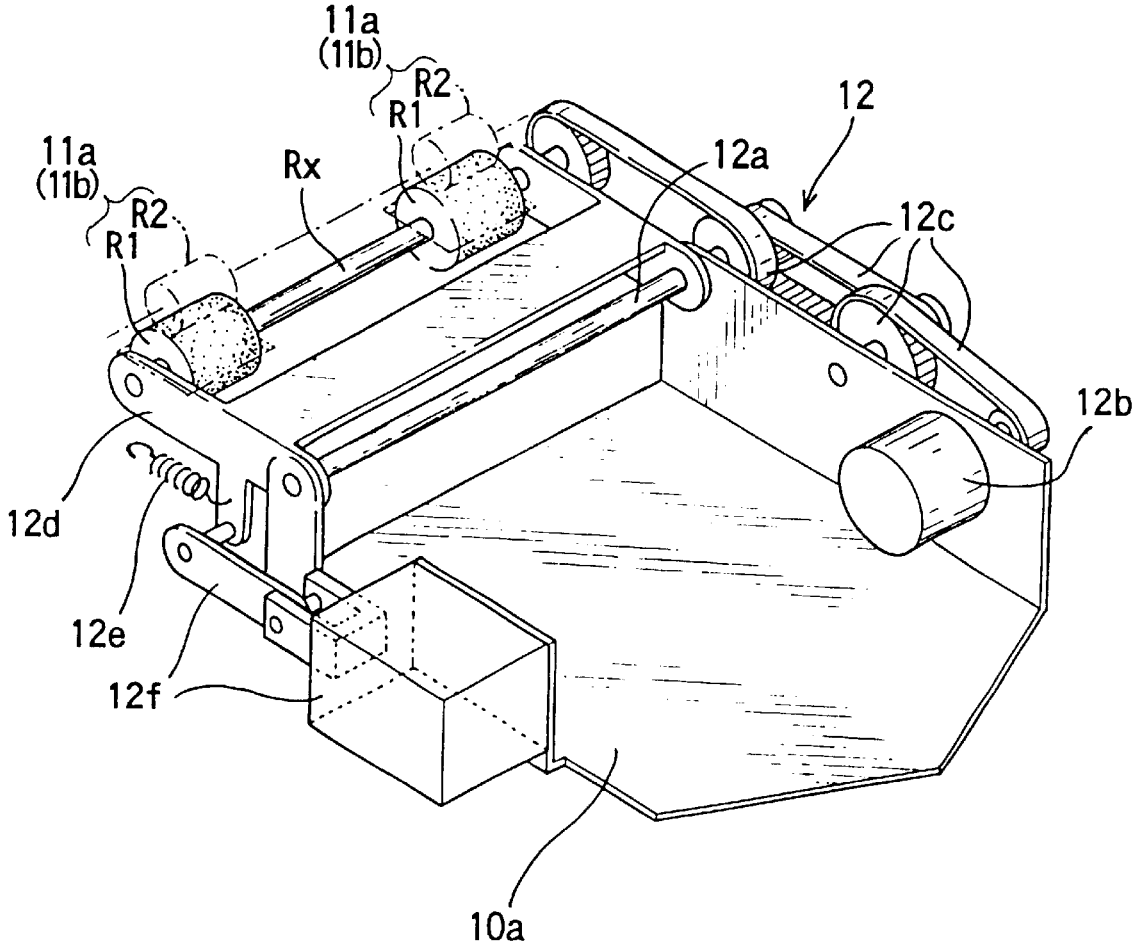
FIG. 5 is a perspective view showing, in part, direction changing means in the apparatus of the invention.
Figure 6:
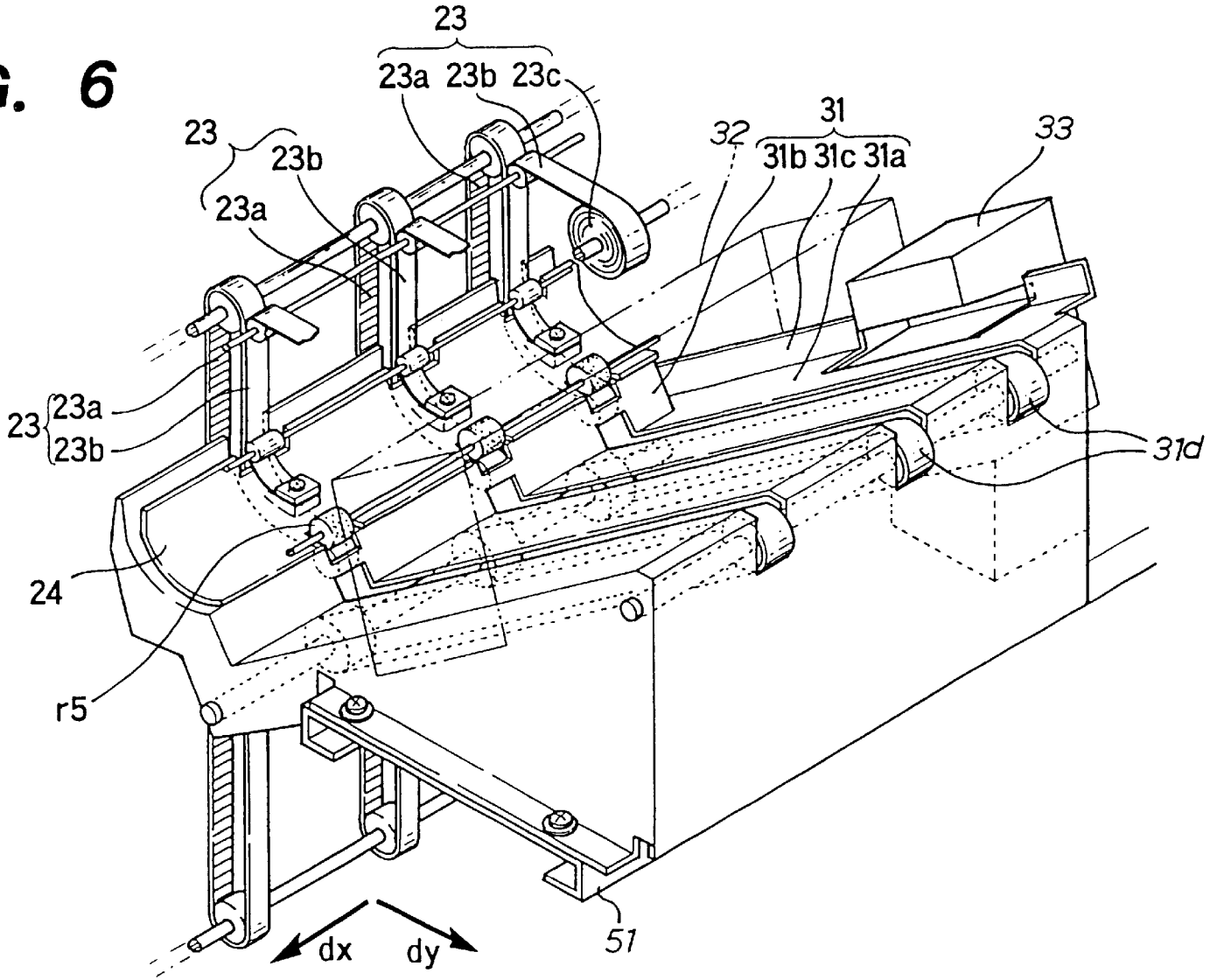
FIG. 6 is a schematic perspective view showing a sheet processing portion in the apparatus of the invention.

FIG. 5 shows a driving mechanism 12 for rotating the driving roller R1 and bringing the driving roller R1 in contact with the counterpart driven roller R2. Although the driving mechanism 12 for the transversely feeding means 11*a* is specially illustrated in FIG. 5, but the same is true of the breadthwise feeding means 11*b*.

The driving mechanism 12 serves to cause the driving rollers R1 to rotate on a rotating shaft Rx in order to forward the sheet, and to rockingly revolve the driving rollers R1 around a rotating shaft 12*a* so as to move the driving rollers R1 to and fro relative to the opposed driven rollers R2. To carry out such functions, the driving mechanism 12 comprises driving means 12*b* such as a motor mounted on a holder 10*a* secured on the sheet receiving stage 10, rotation transmitting means 12*c* including timing belts, pulleys and so on, a rocking frame 12*d* which supports the rotating shaft Rx for the driving rollers R1 and is rotatable for rotating the driving rollers R1 around the shaft 12*a*, means 12*e* for urging the rocking frame 12*d* upward so as to bring the driving rollers R1 in press contact with the driven rollers R2 in a usual state, and rotating means 12*f* such as an electromagnetic solenoid for rockingly revolving the rocking frame 12*d* around the shaft 12*a*.

By operating the driving mechanism 12, the driving means 12*b* is actuated to rotate the driving rollers R1 being in press contact with the driven rollers R2, consequently to forward the sheet held between the driving and driven rollers R1 and R2.

Thus, the sheet sent from the image forming device M to the sheet receiving stage 10 is first forwarded in the reference transferring direction dx by the paired rollers of the transversely feeding means 11*a*, and then, sent out from the sheet receiving stage 10 in the direction perpendicular to the direction dx toward the sheet reversing path 20 by the paired rollers of the breadthwise feeding means 11*b*. The recorded sheet is introduced from the sheet receiving stage 10 into the sheet reversing path 20 by feed rollers r4.

The sheet reversing path 20 through which the recorded sheet Sa sent from the sheet receiving stage 10 is delivered to the processing portion 30 includes a curved introduction member 22, a vertical transfer part 23, and a curved guide member 24 which is secured on the sheet stacking platform 31. The curved introduction member 22 and the curved guide member 24 constitutes a half-around passage by which the sheet passing therethrough is turned upside down.

The vertical transfer part 23 is formed of endless conveyor belts 23*a*, pressure tapes 23*b* being in contact with the conveyor belts 23*a*, and driving means 23*d* such as a motor for driving the conveyor belts 23*a*.

The pressure tape 23*b* is connected at its one end with the guide member 24 secured to the sheet stacking platform 31, and at its other end with a hoisting roll 23*c* so as to be subjected to a tension force. As the sheet stacking platform 31 moves vertically, the pressure tape 23*b* is forcibly wound up or unwound by the hoisting roll 23*c* to be strained constantly while coming into contact with the conveyor belt 23*a*. As a result, the sheet introduced into between the conveyor belts 23*a* and the pressure tapes 23*b* can be stably forwarded toward the processing portion 30.

The sheet stacking platform 31 in the processing portion 30 is formed of a sheet guide surface 31*a* having gradually increasing height toward the sheet discharging side (front side portion Fs), a tail keeper 31*b* for retaining the tail ends of the recorded sheets delivered at the platform 31, and a side keeper 31*c* for truing up the side edges of the sheets.

The tail ends of the sheets on the slanting guide surface 31*a* are exactly aligned by their own weight at the tail keeper 31*b*.

The sheets delivered at the platform 31 are pressed against the side keeper 31*c* by the sheet aligning means 32, 50 as to be aligned laterally.

Figure 3:
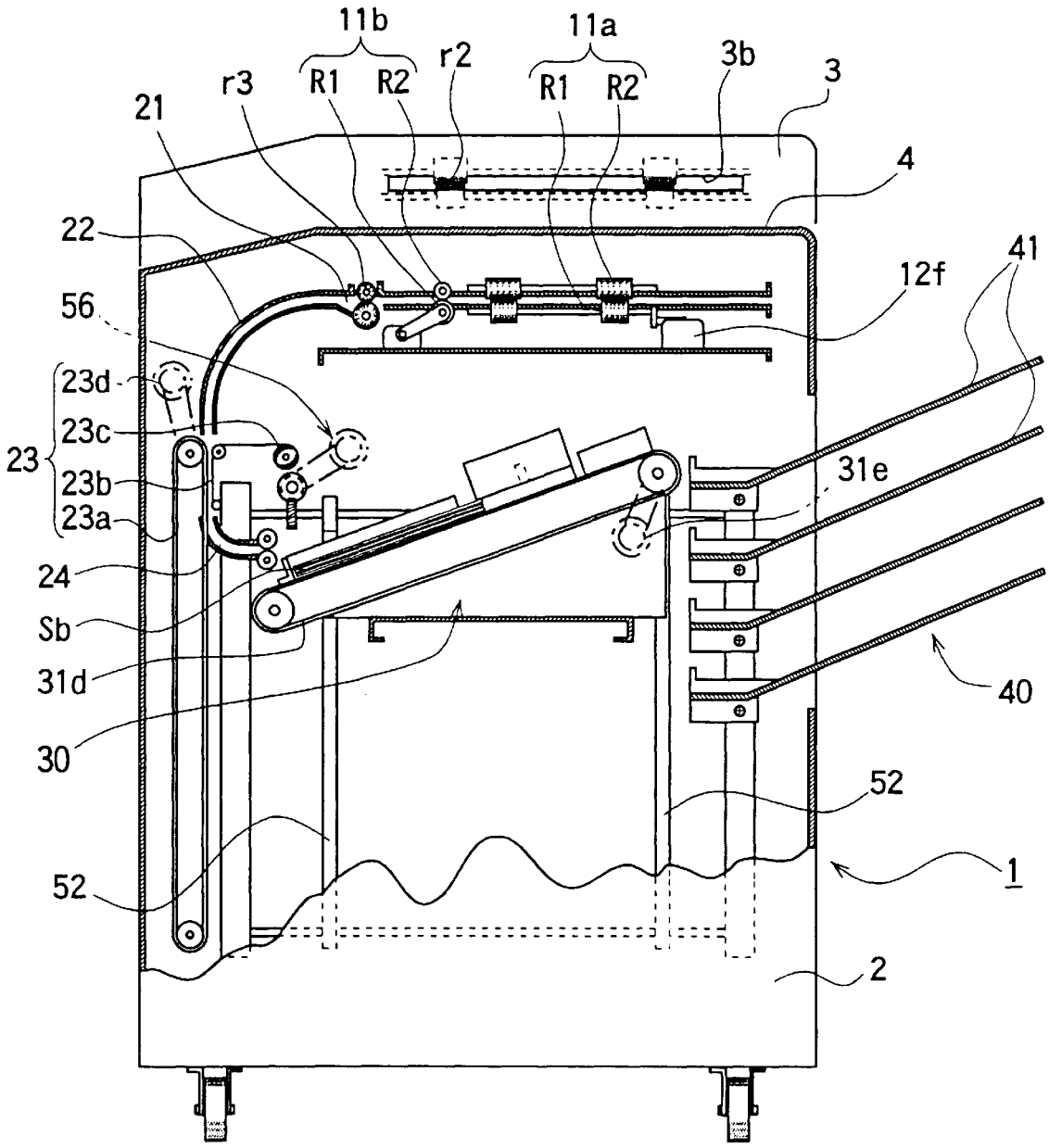
FIG. 3 is a cross sectional side view showing the apparatus of FIG. 2.
Figure 4:
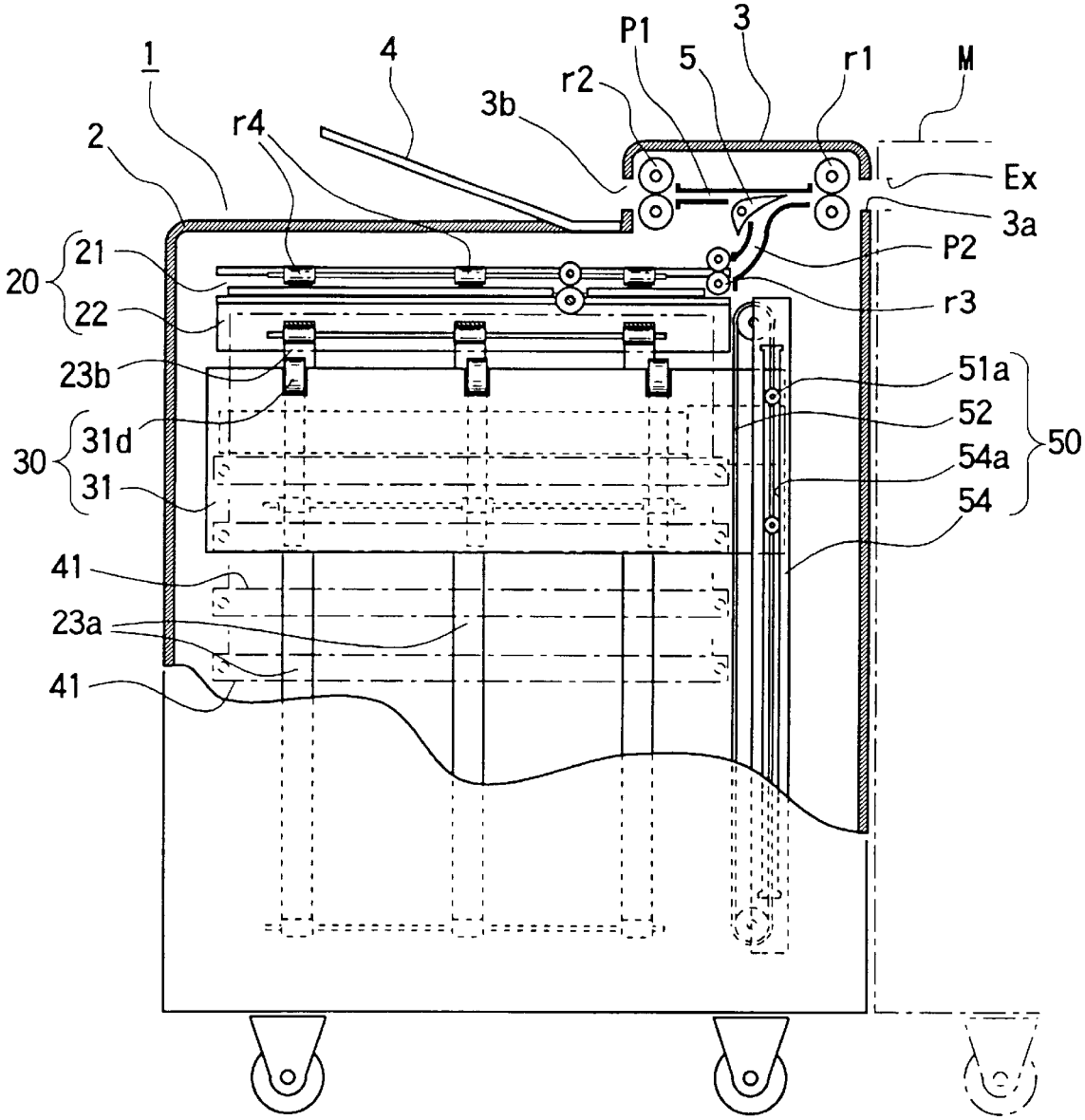
FIG. 4 is a cross sectional front view showing the apparatus of FIG. 2.

The sheet stacking platform 31 incorporates conveyor belts 31*d* for sending out the sheets on the sheet guide surface 31*a* in a sheet discharging direction dy toward the front side portion Fs. The conveyor belts 31*d* are driven by use of driving means 31*e* such as a motor (FIG. 3).

Figure 7:
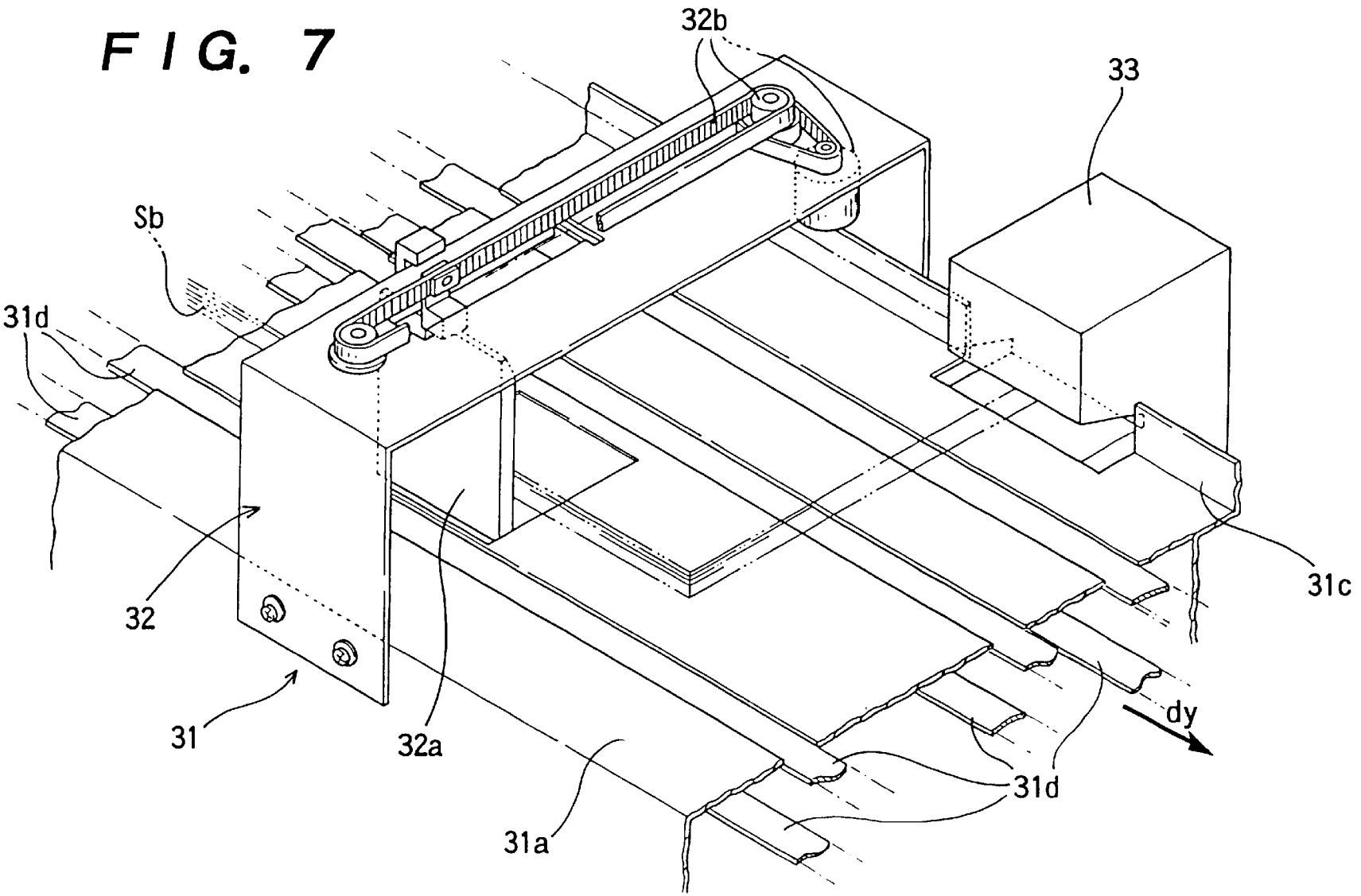
FIG. 7 is a schematic perspective view showing sheet aligning means in the apparatus of the invention.

The sheet aligning means 32 is disposed across the sheet stacking platform 31, and comprises a lateral pressure member 32*a* for pressing the sheets stacked on the guide surface 31*a* against the side keeper 31*c* as indicated by the arrow in FIG. 7, and a driving system 32*b* for moving the pressure member 32*a* laterally, which includes a driving belt, pulleys, and a motor.

The sheet binding means 33 may be formed of a stapler for thrusting at least one staple into the sheets stacked on the sheet stacking platform 31 and aligned laterally at the side keeper 31*c* by the sheet aligning means 32 to bind the sheets into a sheaf Sb.

The staple can be thrust at one or more arbitrary positions of the sheets Sb stacked on the platform 31 by driving the conveyor belts 31*d* to move the sheets Sb in the sheet discharging direction.

Instead of the stapler, a puncher capable of making binding one or more binding holes in the sheets may be used as the sheet binding means 33 to bind the sheets into a sheaf.

The sheet stacking platform 31 is movable vertically, so that it can be situated facing a specified one of the discharge trays 41 arranged vertically in the sheet discharge unit 40 so as to discharge the sheets bound with one or more staples to the specified discharge tray.

Figure 8:
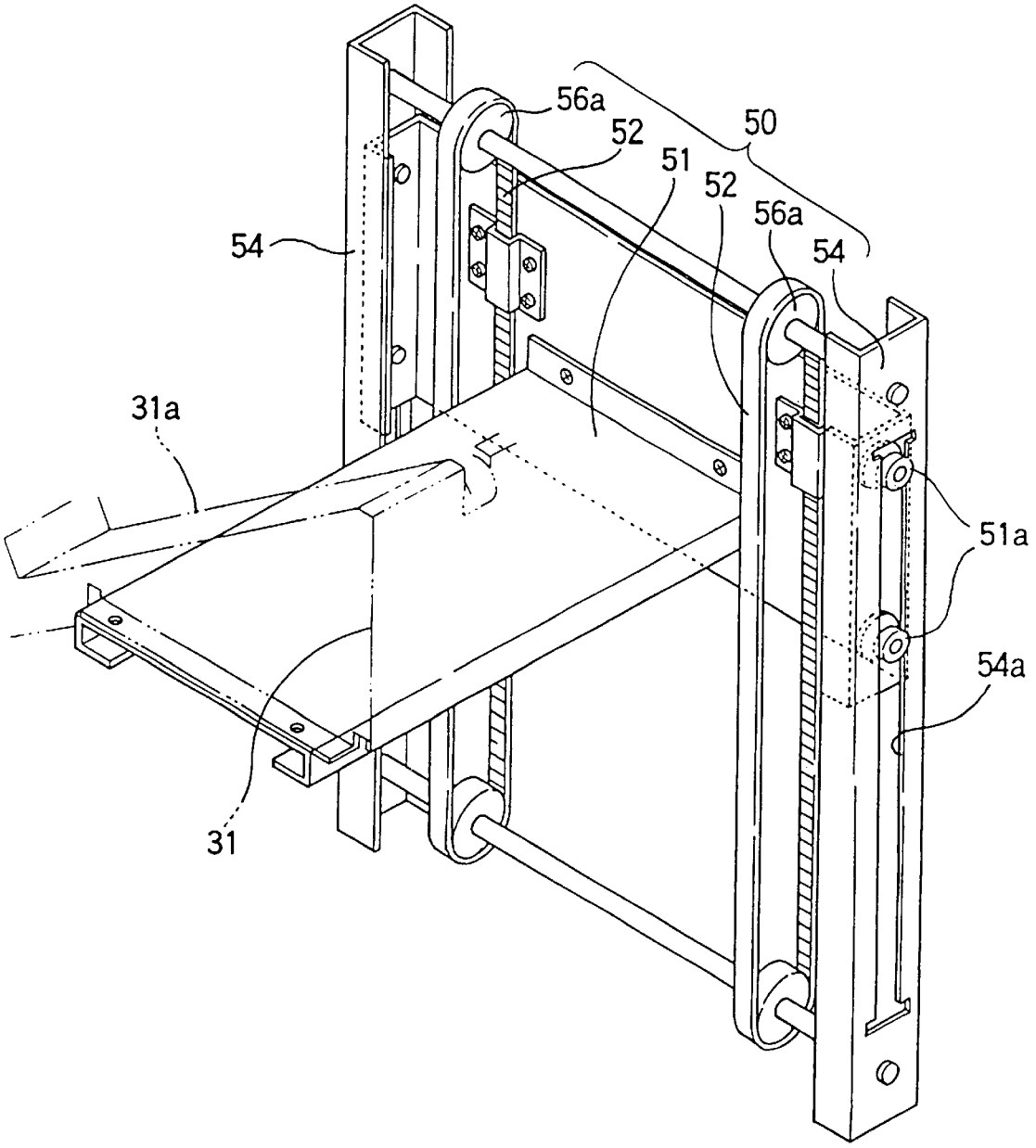
FIG. 8 is a schematic perspective view showing a lifting mechanism for vertically moving a sheet stacking platform in the apparatus of the invention.

The sheet stacking platform 31 is vertically moved by a lifting mechanism 50 as shown in FIG. 8. The lifting mechanism 50 is formed of a lifting frame 51 fixed onto the sheet stacking platform 31 and having guide rollers 51*a*, lifting belts 52 for moving the lifting frame 51 vertically, guide members 54 each having a guide slot 54*a* for permitting vertical movement of the guide rollers 51*a* of the lifting frame 51, and driving means 56 including pulleys 56*a* for driving the lifting belts 52.

As described above, according to the sheet post-processing apparatus of the invention, the recorded or copied sheets Sa with the image surfaces upward, which are successively sent out from the image forming device M laterally in the reference transferring direction dx, are forwarded in the perpendicular direction to the reference transferring direction at the sheet receiving stage 11 and turned upside down when passing through the sheet reversing path 20, consequently to be stacked with the image surfaces downward on the sheet stacking platform 31 in the prescribed order of page. The sheets stacked on the platform 31 are aligned and shifted in position in the sheet discharging direction to adjust the sheet position to be bound with a staple. Upon undergoing a stapling process, the sheets Sb bound in a sheaf are sent out in the sheet discharging direction to the specified one of the discharge trays 41. Since the sheet discharge unit 40 incorporating the discharge trays 41 is disposed close to the operation place in front of the image forming device, an operator can easily take out the finished sheets bound from the discharge trays 41 without moving too much.

Figure 9A:
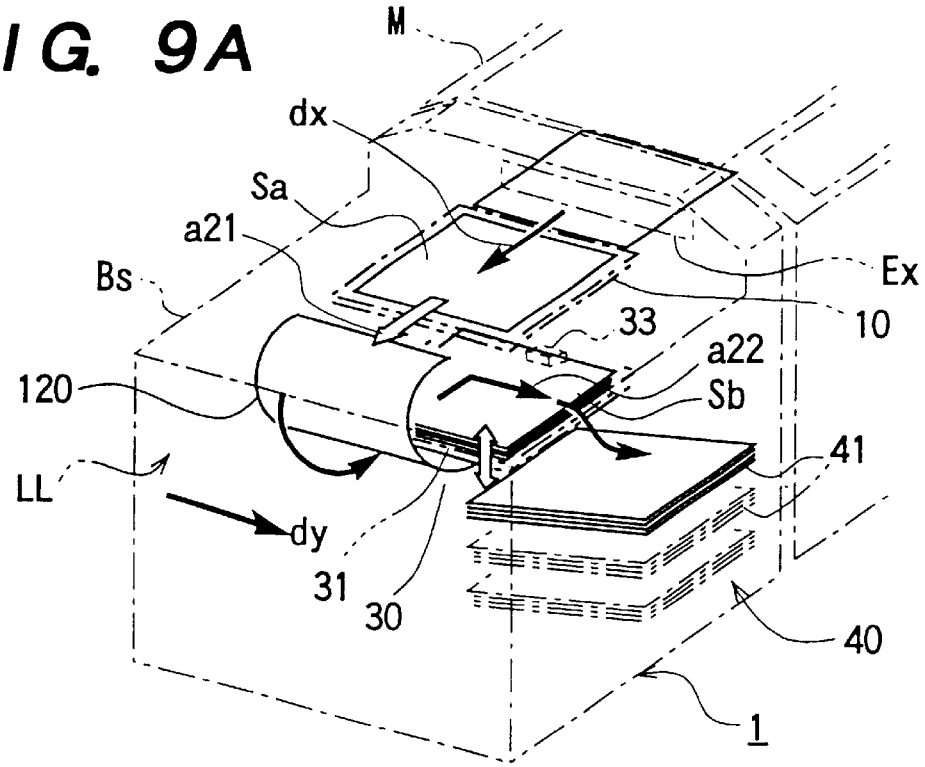
FIG. 9A is a conceptual diagram showing the manner of transferring the recorded sheet in a second embodiment of this invention.
Figure 9B:
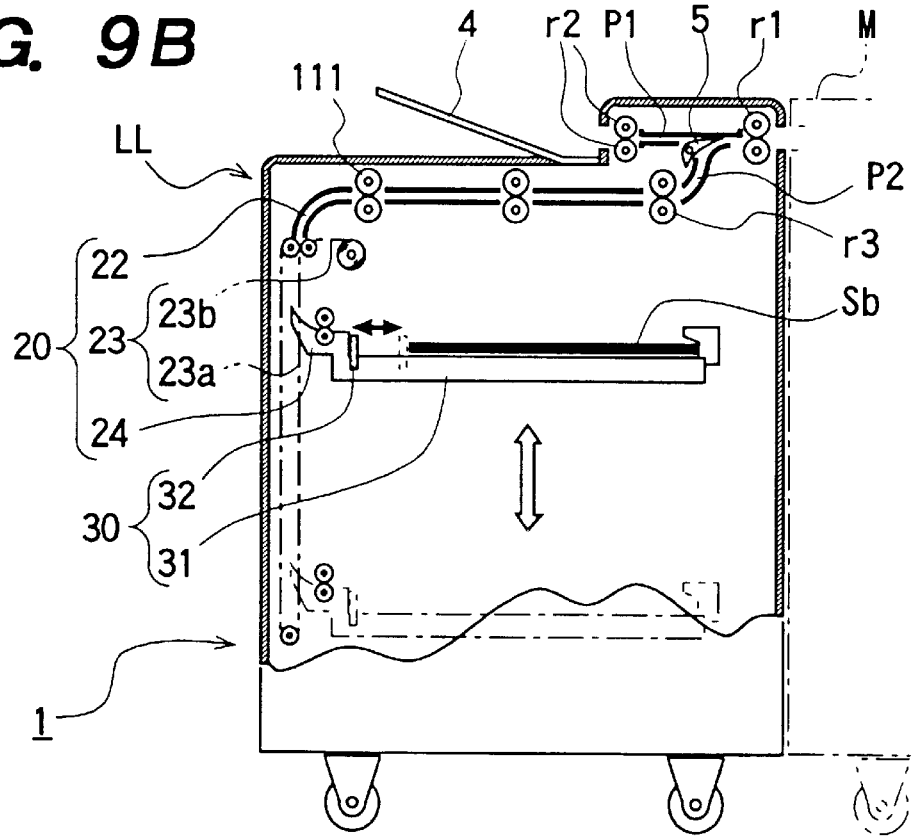
FIG. 9B is a sectional front view schematically showing the apparatus of FIG. 9A.

The sheet reversing path for forwarding and turning the recorded sheet introduced from the sheet receiving stage 10 may be changed in position as illustrated in FIG. 9A and FIG. 9B. That is to say, the sheet reversing path 120 in this second embodiment is positioned on the downstream side LL of the processing portion 30 relative to the reference transferring direction dx.

In this embodiment, the sheet Sa with the image surface upward sent from the image forming device M to the sheet receiving stage 10 is sent out from the sheet receiving stage 10 in the reference transferring direction dx as indicated by the arrow a21 and delivered to the processing portion 30 through the sheet reversing path 120. When passing through the sheet reversing path 120, the sheet Sa is turned upside down and stacked with the image surface downward on the sheet stacking platform 31. The sheets successively fed to and stacked on the sheet stacking platform 31 are aligned and bound with one or more staples by use of the sheet binding means 33 in the same manner as specified above in connection with the first embodiment.

Then, the finished sheets Sb thus stapled are discharged in the perpendicular direction dy to the reference transferring direction dx as indicated by the arrow a22 and sent onto the specified one of the discharge trays 41 of the sheet discharge unit 40 situated close to the operation place of the image forming device M.

To change the direction in which the sheets Sb is forwarded on the sheet stacking platform 31, the processing portion 30 incorporates the direction changing means 11*a* and 11*b* as shown in FIG. 5, but there is no need for such direction changing means in the sheet receiving stage 10. The sheet receiving stage 10 may be provided merely with feed rollers 111 for forwarding the sheet only in the reference transferring direction dx as shown in FIG. 9B.

In this second embodiment, the components depicted by the same numerals and symbols as those of the first embodiment have analogous structures and functions to those of the first embodiment and will not be described in detail again.

According to this second embodiment, the finished sheets Sb bound in a sheaf can be finally discharged to the position close to the operation place in front of the image forming device, consequently to allow the operator to easily take out the bound sheets from the discharge tray without moving too much, similarly to the first embodiment as described previously.

Figure 10A:
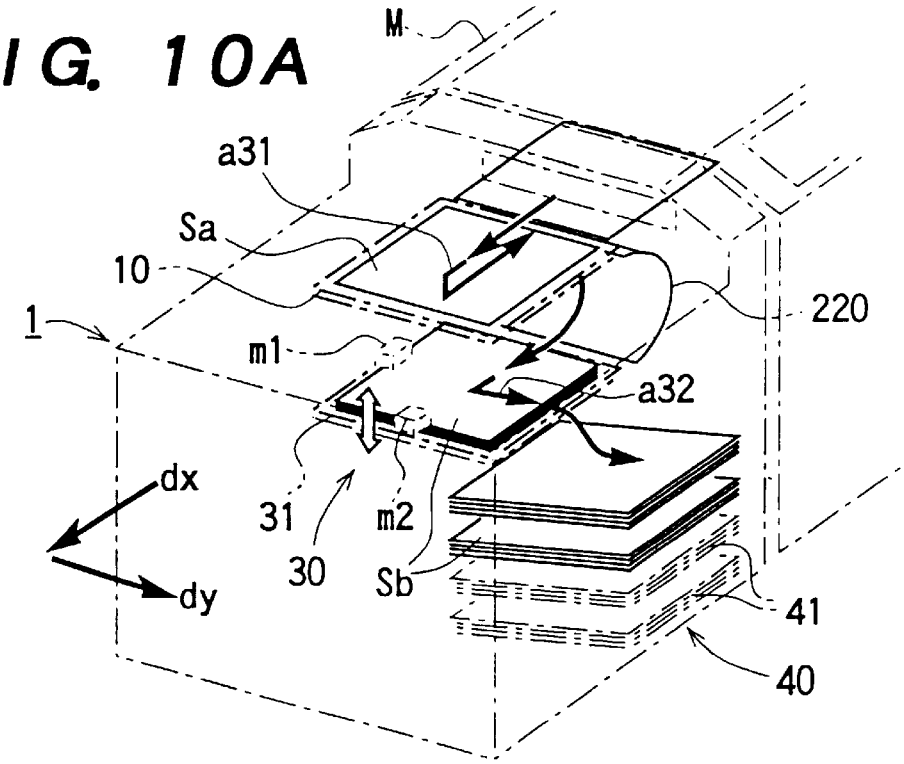
FIG. 10A is a conceptual diagram showing the manner of transferring the recorded sheet in a third embodiment of this invention.
Figure 10B:
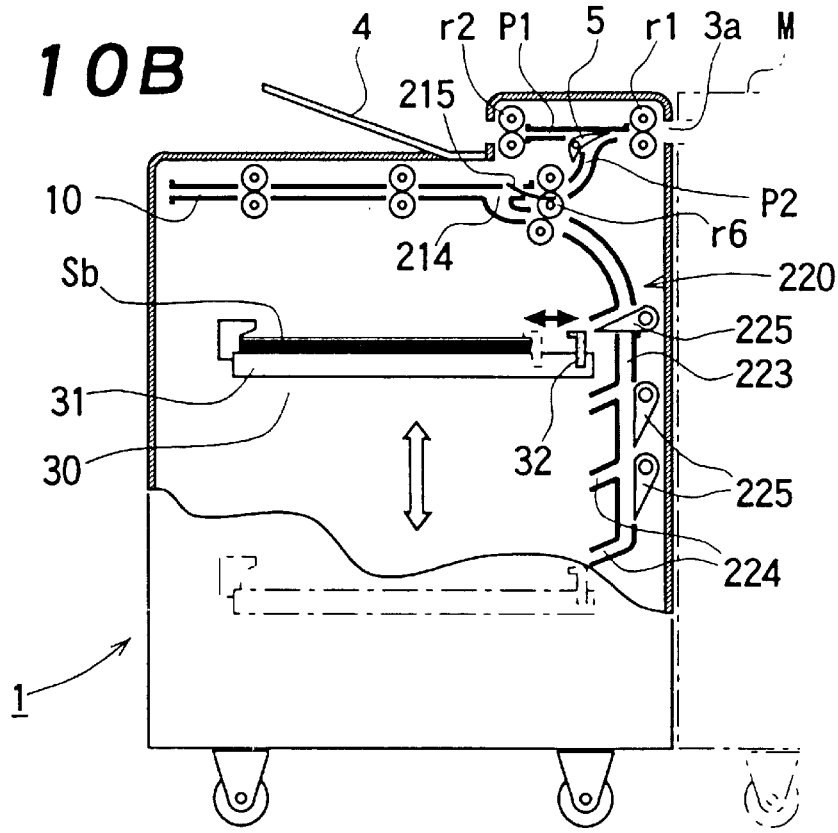
FIG. 10B is a sectional front view schematically showing the apparatus of FIG. 10A.

Also, the third embodiment shown in FIG. 10A and FIG. 10B has the same effect of automatically collating, aligning and binding recorded sheets given from the image forming device and further allowing the operator to easily take out the finished sheets bound finally.

In the third embodiment, the sheet reversing path 220 is disposed on the upstream side of the processing portion 30 relative to the reference transferring direction dx. The sheet Sa is fed in the reference transferring direction dx from the image forming device M into the sheet receiving stage 10, and then, sent back in the reverse direction as indicated by the arrow a31. The sheet Sa sent backward is introduced into the sheet reversing path 220.

The sheet reversing path 220 in this embodiment has branch paths 224 having the substantially same height as the respective discharge trays 41 of the discharge unit 40, and switching flaps 225 for selectively forwarding the sheet Sa to the specified one of the branch paths 224. When one of the branch paths 224 is specified, the sheet stacking platform 31 is positioned facing the specified branch path to stack thereon the sheet forwarded through the sheet reversing path 220. The sheets successively delivered from the image forming device M are stacked in turn on the sheet stacking platform 31, and then, aligned and bound with one or more staples.

The stapler for thrusting the staple into the sheets may be disposed at either of the positions m1 and m2 as illustrated.

Similarly to the second embodiment described above, the finished sheets Sb thus stapled are discharged in the perpendicular direction dy to the reference transferring direction dx as indicated by the arrow a32 and sent onto the specified one of the sheet discharge trays 41 situated close to the operation place in front of the image forming device M.

To change the direction in which the sheets Sb are forwarded on the sheet stacking platform 31, the processing portion 30 incorporates the direction changing means 11*a* and 11*b* as shown in FIG. 5, but there is no need for such direction changing means in the sheet receiving stage 10. The sheet receiving stage 10 in this embodiment has a diverging point 214 connecting with the sheet reversing path 220. At the diverging point 214, there is an elastic gate member 215 for preventing the sheet introduced into the sheet receiving stage 10 from being sent back to the path P2.

Also, in this embodiment, the components depicted by the same numerals and symbols as those of the first and second embodiments have analogous structures and functions to those of the first or second embodiment.

Similarly to the foregoing embodiments, this third embodiment also achieves a convenient effect in that the finished sheets Sb bound in a sheaf can be finally discharged to the position close to the operation place in front of the image forming device, consequently to allow the operator to easily take out the bound sheets from the sheet discharge tray.

As is apparent from the foregoing description, according to the present invention, the sheets successively fed from an image forming device such as a copying machine and a printer can be automatically collated, aligned, and bound with one or more staples, and the finished sheaf of sheets bound can be discharged to a position near an operator standing in front of the image forming device, so that the operator can easily take out the finished sheaf of sheets bound without moving from the operation place in front of the image forming device. Furthermore, since the recorded sheet sent out with the image surface upward from the image forming device in the specified order of page is turned upside down so as to permit the sheets successively given to be stacked in the proper order of page on a sheet stacking platform, the sheets can be stacked and bound in the proper order of page on the sheet stacking platform. Besides, since the sheet post-processing apparatus of the invention has ingenious passages for reliably transferring recorded or copied sheets arriving from the image forming device, the system including the sheet post-processing apparatus according to this invention can be made compact.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is:

1. A sheet post-processing apparatus connected to an image forming device for collating, aligning and binding or punching sheets arriving from said image forming device, said sheet post-processing apparatus comprising:

a processing portion having a sheet stacking platform for stacking the sheets successively delivered one by one in a reference transferring direction from the image forming device, means for aligning the sheets stacked on the sheet stacking platform and means for processing said sheets into a sheaf on said sheet stacking platform; and a sheet discharge unit situated perpendicularly to said reference transferring direction relative to said processing portion and provided with a plurality of discharge trays for receiving said sheets fed from said processing portion so as to discharge said sheets perpendicularly to said reference transferring direction and distribute and sort said sheets into selected discharge trays in said plurality of discharge trays.

2. A sheet post-processing apparatus connected to an image forming device provided on its one side with a sheet exit port to collate, align and bind or punch recorded sheets discharged successively in a reference transferring direction laterally from said sheet exit port of said image forming device, said sheet post-processing apparatus comprising:

a sheet receiving stage for receiving the recorded sheets given from said image forming device one by one;

a sheet reversing path for forwarding and turning upside down the recorded sheets from said sheet receiving stage;

a processing portion having a sheet stacking platform for stacking the recorded sheets successively delivered in a reference transferring direction from the image forming device, means for aligning the recorded sheets stacked on the sheet stacking platform, and means for processing said sheets into a sheaf on said sheet stacking platform; and a sheet discharge unit situated perpendicularly to said reference transferring direction relative to said processing portion and provided with a plurality of discharge trays for receiving said sheets fed from said processing portion, whereby said sheets fed from said processing portion are discharged perpendicularly to said reference transferring direction from said processing unit and distributed and sorted into selected discharge trays in said plurality of discharge trays.

3. A sheet post-processing apparatus claimed in claim 2, wherein said sheet reversing path is situated perpendicularly to said reference transferring direction relative to said sheet receiving stage, so that said sheet arriving from said image forming device changes its direction on said sheet receiving stage and is sent from said sheet receiving stage into said sheet reversing path perpendicularly to said reference transferring direction.

4. A sheet post-processing apparatus claimed in claim 2, wherein said sheet reversing path is situated on a downstream side of said processing portion relative to said reference transferring direction, so that said sheets arriving from said image forming device are sent one by one in said reference transferring direction from said sheet receiving stage to said processing portion through said sheet reversing path, stacked on said sheet stacking platform, and processed into a sheaf, and said sheaf of sheets is discharged perpendicularly to said reference transferring direction to said sheet discharge unit.

5. A sheet post-processing apparatus claimed in claim 2, wherein said sheet reversing path is situated on an upstream side of said processing portion relative to said reference transferring direction, so that said sheets are sent one by one from said image forming device to said sheet receiving stage in said reference transferring direction, sent back from said sheet receiving stage to said processing portion through said sheet reversing path, stacked on said sheet stacking platform, and processed into a sheaf, and said sheaf of sheets is discharged perpendicularly to said reference transferring direction to said sheet discharge unit.

6. A sheet post-processing apparatus connected to an image forming device provided on its front side with an operating portion and on its one side with a sheet exit port to collate, align and bind or punch recorded sheets discharged successively in a reference transferring direction laterally from said sheet exit port of said image forming device, said sheet post-processing apparatus comprising:

a sheet reversing path for forwarding and turning upside down the recorded sheet from said image forming device;

a processing portion having a sheet stacking platform for stacking the recorded sheet successively delivered one by one in a reference transferring direction from the image forming device, means for aligning the recorded sheets stacked on the sheet stacking platform and means for processing said sheets into a sheaf on said sheet stacking platform; and a sheet discharge unit situated perpendicularly to said reference transferring direction relative to said processing portion and provided with a plurality of discharge trays arranged as separated vertically from one another to receive said sheets processed in said processing portion, said plurality of discharge trays being disposed on said front side of said image forming device so as to discharge said sheets to a portion close to said operating portion of said image forming device and distribute and sort said sheets into selected discharge trays in said plurality of discharge trays.

7. A sheet post-processing apparatus connected to an image forming device provided on its front side with an operating portion and on its one side with a sheet exit port to collate, align and bind or punch recorded sheets discharged successively in a reference transferring direction laterally from said sheet exit port of said image forming device, said sheet post-processing apparatus comprising:

a sheet receiving stage for receiving the recorded sheets given from said image forming device one by one;

a sheet reversing path for forwarding and turning upside down the recorded sheet sent from said sheet receiving stage;

processing portion having a sheet stacking platform disposed under said sheet receiving stage to stack the recorded sheets successively delivered one by one in a reference transferring direction from the image forming device, means for aligning the recorded sheets stacked on the sheet stacking platform and means for processing said sheets into a sheaf on said sheet stacking platform; and a sheet discharge unit situated perpendicularly to said reference transferring direction relative to said processing portion and provided with a plurality of discharge trays arranged movably vertically and separated vertically from one another to receive said sheets processed in said processing portion, said plurality of discharge trays being disposed on said front side of said image forming device so as to discharge said sheets to a portion close to said operating portion of said image forming device and distribute and sort said sheets into selected discharge trays in said plurality of discharge trays.

8. A sheet post-processing apparatus claimed in claim 7, wherein said sheet reversing path is situated perpendicularly to said reference transferring direction relative to said sheet receiving stage, so that said sheet arriving from said image forming device changes its direction on said sheet receiving stage and is sent from said sheet receiving stage into said sheet reversing path perpendicularly to said reference transferring direction.

9. A sheet post-processing apparatus claimed in claim 8, wherein said sheet receiving stage is provided with direction changing means for permitting said sheet delivered from said image forming device to said sheet receiving stage to change its direction perpendicularly to said reference transferring direction, said direction changing means including transversely feeding means having movable and separable driving rollers and stationary driven rollers held by rotary shafts extending perpendicularly to the reference transferring direction so as to forward the recorded sheet in said reference transferring direction, and breadthwise feeding means having movable and separable driving rollers and stationary driven rollers held by rotary shafts extending in parallel to the reference transferring direction so as to forward the recorded sheet perpendicularly to said reference transferring direction.

10. A sheet post-processing apparatus claimed in claim 7, wherein said sheet reversing path is situated on a downstream side of said processing portion relative to said reference transferring direction, so that said sheets arriving from said image forming device are sent one by one in said reference transferring direction from said sheet receiving stage to said processing portion through said sheet reversing path, stacked on said sheet stacking platform, and processed into a sheaf, and said sheaf of sheets is discharged perpendicularly to said reference transferring direction to said sheet discharge unit.

11. A sheet post-processing apparatus claimed in claim 7, wherein said sheet reversing path is situated on an upstream side of said processing portion relative to said reference transferring direction, so that said sheets are sent one by one from said image forming device to said sheet receiving stage in said reference transferring direction, sent back from said sheet receiving stage to said processing portion through said sheet reversing path, stacked on said sheet stacking platform, and processed into a sheaf, and said sheaf of sheets is discharged perpendicularly to said reference transferring direction to said sheet discharge unit.

12. A sheet post-processing apparatus claimed in claim 7, wherein said sheet reversing path includes a vertical transfer part formed of endless conveyor belts, pressure tapes being in contact with said conveyor belts, and means for driving said conveyor belts to forward the recorded sheet along between said conveyor belts and pressure tapes.

* * * * *